US006787980B2

(12) United States Patent
Honda

(10) Patent No.: US 6,787,980 B2
(45) Date of Patent: Sep. 7, 2004

(54) MERCURY-CONTAINING MATERIAL, METHOD FOR PRODUCING THE SAME AND FLUORESCENT LAMP USING THE SAME

(75) Inventor: Kouji Honda, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 110 days.

(21) Appl. No.: 09/957,521

(22) Filed: Sep. 19, 2001

(65) Prior Publication Data

US 2002/0036468 A1 Mar. 28, 2002

(30) Foreign Application Priority Data

Sep. 22, 2000 (JP) ..... 2000-288374

(51) Int. Cl.[7] ..... H01J 1/62; H01J 63/04; H01J 17/26

(52) U.S. Cl. ..... 313/490; 313/565; 313/639

(58) Field of Search ..... 313/489, 490, 313/550, 545–546, 635–639, 551, 564, 565, 484; 427/216, 212, 215, 419.1, 419.2, 419.8, 431, 435, 430; 435/430.1, 431, 435

(56) References Cited

U.S. PATENT DOCUMENTS 3,657,589 A * 4/1972 Della Porta et al. ..... 313/556
3,878,034 A * 4/1975 Bever et al. ..... 428/34.1
3,895,709 A * 7/1975 Przybylek ..... 206/525
3,913,999 A * 10/1975 Clarke ..... 445/9
4,056,750 A * 11/1977 Latassa ..... 313/546
4,145,634 A * 3/1979 Evans et al. ..... 313/490
4,803,400 A * 2/1989 Peters et al. ..... 313/489
5,374,871 A 12/1994 Johnson
5,604,396 A * 2/1997 Watanabe et al. ..... 313/485
5,828,169 A * 10/1998 Myojo et al. ..... 313/490
6,285,126 B1 * 9/2001 Evans et al. ..... 313/550
6,661,175 B2 * 12/2003 Brumleve ..... 313/638

FOREIGN PATENT DOCUMENTS

JP 06-005256 * 1/1994 ..... H01J/61/24
JP 2001-52648 2/2001 ..... H01J/61/35

* cited by examiner

*Primary Examiner*—Sandra O'Shea
*Assistant Examiner*—Peter Macchiarolo
(74) *Attorney, Agent, or Firm*—Merchant & Gold P.C.

(57) ABSTRACT

A mercury-containing material, a method for producing the same and a fluorescent lamp using the same that can enclose a minimal amount of mercury in a glass bulb precisely, prevent flaws in a fluorescent coating while suppressing a noise during a lamp transportation, and prevent deterioration in appearance are provided. A surface of liquid mercury is coated with a continuous film made of metal oxide or metal complex oxide by dipping the mercury in a metal alkoxide solution and then heating the mercury on which the metal alkoxide solution adheres. Accordingly, the minimal amount of the mercury can be enclosed in the fluorescent lamp precisely, thus achieving friendliness to the environment. It also is possible to prevent flaws in the fluorescent coating while suppressing a noise during the lamp transportation and further to prevent deterioration in appearance.

12 Claims, 2 Drawing Sheets

MERCURY-CONTAINING MATERIAL, METHOD FOR PRODUCING THE SAME AND FLUORESCENT LAMP USING THE SAME

BACKGROUND OF THE INVENTION

1. Field of the Invention

The present invention relates to a mercury-containing material, a method for producing the same and a fluorescent lamp using the same.

2. Description of Related Art

In a conventional process for producing a fluorescent lamp, mercury is enclosed in the lamp in the following method. Stems having a filament and an exhaust pipe are sealed at the ends of a glass bulb whose inner surface is coated with a fluorescent substance. Subsequently, impurities are exhausted from the glass bulb through the exhaust pipe, and liquid mercury is enclosed in the glass bulb through the exhaust pipe immediately before finishing this exhaustion.

In order to enclose precisely a minimal amount of mercury, another known method of enclosing mercury in the fluorescent lamp includes enclosing a mercury alloy (a mercury-containing material) formed of, for example, mercury and zinc in the glass bulb through the exhaust pipe immediately before finishing exhausting the glass bulb.

The enclosed mercury alloy sometimes is fixed inside the glass bulb so as not to move freely therein.

However, in the conventional process for producing the fluorescent lamp, in particular, in the method of enclosing the liquid mercury directly in the glass bulb, there has been a problem that a predetermined amount of mercury cannot be enclosed. This is because a part of the liquid mercury adheres to a mercury enclosing apparatus or evaporates owing to heat during the exhaustion so as to be exhausted along with an impure gas.

In order to solve the above problem, there is a method of enclosing mercury in an amount somewhat larger than necessary in the glass bulb. However, it is not preferable, in practice, to enclose an excessive amount of mercury, which is unfriendly to the environment.

On the other hand, the method of enclosing the solid mercury alloy instead of the liquid mercury in the glass bulb has had problems that, when the mercury alloy is not fixed inside the fluorescent lamp, it collides against the fluorescent coating during a lamp transportation so as to make linear and pinhole-shaped flaws in the fluorescent coating and that such a collision makes a noise. There also has been a problem that, during a lamp operation, a dark shadow of the mercury alloy appears on the fluorescent lamp, thus deteriorating the appearance.

Also, even if the mercury alloy is fixed inside the fluorescent lamp in a production process, it comes off relatively easily because of an impact during the lamp transportation, leading to the various problems described above.

SUMMARY OF THE INVENTION

It is an object of the present invention to solve the problems described above and to provide a mercury-containing material, a method for producing the same and a fluorescent lamp using the same that can enclose a minimal amount of mercury in a glass bulb precisely, prevent flaws in a fluorescent coating while suppressing a noise during lamp transportation, and prevent deterioration in appearance.

A mercury-containing material of the present invention includes liquid mercury, and a continuous film with which a surface of the liquid mercury is coated.

With this structure, since the liquid mercury is coated with the continuous film, the mercury can be prevented from, as seen conventionally, adhering to the enclosing apparatus and evaporating to be exhausted during an exhausting process. Thus, a minimal amount of mercury can be enclosed precisely in a fluorescent lamp. Also, since the continuous film is flexible, it is possible to suppress flaws and noises caused by a collision of this continuous film against a fluorescent coating of the fluorescent lamp. Moreover, since the continuous film is thin so as to have a large light transmittance, a shadow of the continuous film can be prevented from being cast on the fluorescent lamp during lamp operation.

In the mercury-containing material, the continuous film is made of at least one material selected from the group consisting of a metal oxide and a metal complex oxide. With this structure, it is possible to prevent a reaction between a substance forming the continuous film and an activated mercury ion during the lamp operation, leading to a decrease in mercury contributing to a discharge.

It is preferable that the continuous film has a thickness of 0.1 to 1.0 mm. This is because a continuous film having a thickness of smaller than 0.1 mm would break during handling in the producing process, while that having a thickness of larger than 1.0 mm would be difficult to break when it should be broken intentionally.

Also, it is preferable that the continuous film is formed by layering a plurality of thin films. With this structure, since an amount of a continuous film forming solution smaller than the amount required for forming a thick continuous film at one time sufficiently can be made adhere to the surface of the mercury, it is possible to reduce the amount of heat necessary in a heating process. Consequently, impurities contained in the continuous film forming solution are not absorbed in the continuous film owing to an abrupt heating, so that these impurities would not affect the lamp characteristics adversely.

It is preferable that an innermost thin film of the thin films constituting the continuous film is thinnest. With this structure, it is possible to reduce the amount of heat applied to the continuous film forming solution in the process of forming the first thin film (continuous film). As a result, the amount of heat applied to the solid mercury can be reduced, thereby suppressing the evaporation of the mercury and increasing the accuracy of the enclosed mercury amount.

Furthermore, it is preferable that the mercury-containing material is a spherical body. With this structure, the mercury-containing material can be enclosed in the fluorescent lamp easily.

The mercury-containing material preferably is obtained by making a metal alkoxide solution adhere onto a surface of mercury and heating the metal alkoxide solution on the surface of the mercury. This is because the mercury-containing material obtained in this method has a minimal amount of the mercury coated with the continuous film and a substantially spherical shape that allows easy enclosure into the fluorescent lamp. In addition, since the continuous film is flexible, the mercury-containing material does not damage the fluorescent coating and the lamp has an excellent appearance when the mercury-containing material is enclosed.

Next, a method for producing a mercury-containing material of the present invention, wherein a continuous film is formed on a surface of mercury by (a) dipping the mercury in a continuous film forming solution so as to make the continuous film forming solution adhere onto the surface of the mercury, and (b) heating the continuous film forming solution on the surface of the mercury.

With this method, it is possible to cut waste so as to coat a minimal amount of the mercury with the continuous film. Furthermore, it is possible to form the mercury-containing material into a shape that allows easy enclosure into the fluorescent lamp, that is, a substantially spherical shape.

In the above-described method for producing the mercury-containing material, a solidified mercury, in particular a mercury obtained by solidifying liquid mercury in a noble gas atmosphere, preferably is used as the mercury.

With this method, because the mercury is solidified in advance, it is possible to further eliminate waste so as to coat a minimal amount of the mercury with the continuous film and the handling of the mercury becomes easier when forming the continuous film. Also, by solidifying the liquid mercury in the noble gas atmosphere, it is possible to prevent impure gases (such as oxygen and nitrogen), which affect characteristics of the fluorescent lamp adversely, from being absorbed in the continuous film on the surface of the liquid mercury during the solidification.

In the above-described method for producing the mercury-containing material, it is preferable that a metal alkoxide solution is used as the continuous film forming solution. With this method, it is possible to form the continuous film on the surface of the mercury relatively easily so as to coat a minimal amount of the mercury with continuous film. Furthermore, it is possible to form the mercury-containing material into a shape that allows easy enclosure into the fluorescent lamp, that is, a substantially spherical shape.

In the above-described method for producing the mercury-containing material, it is preferable that a mixed gas of a natural gas and oxygen is used for (b). With this method, since the mixed gas of the natural gas and oxygen does not generate very much moisture at the time of burning, it is possible to prevent the continuous film from absorbing the moisture, thereby reducing an adverse effect on the lamp characteristics caused by the moisture absorption.

In the above-described method for producing the mercury-containing material, it is preferable that a mixed gas of a town gas and oxygen is used for (b). With this method, since the mixed gas of the town gas and oxygen does not generate very much moisture at the time of burning, it is possible to prevent the continuous film from absorbing the moisture, thereby reducing an adverse effect on the lamp characteristics caused by the moisture absorption.

Next, a fluorescent lamp of the present invention includes a glass bulb, in which an enclosed gas and the mercury-containing material are sealed, and a fluorescent coating formed on an inner surface of the glass bulb.

With this structure, a minimal amount of mercury precisely can be enclosed in the fluorescent lamp. Also, since the continuous film is flexible, it is possible to prevent a flaw on the fluorescent coating and a noise that are due to a collision of this continuous film against the fluorescent coating of the fluorescent lamp. Moreover, since the continuous film is thin, the shadow of the continuous film is unlikely to appear on the fluorescent lamp during the lamp operation.

DESCRIPTION OF THE PREFERRED EMBODIMENTS

The following is a description of an embodiment of the present invention, with reference to the accompanying drawings.

Figure 2:
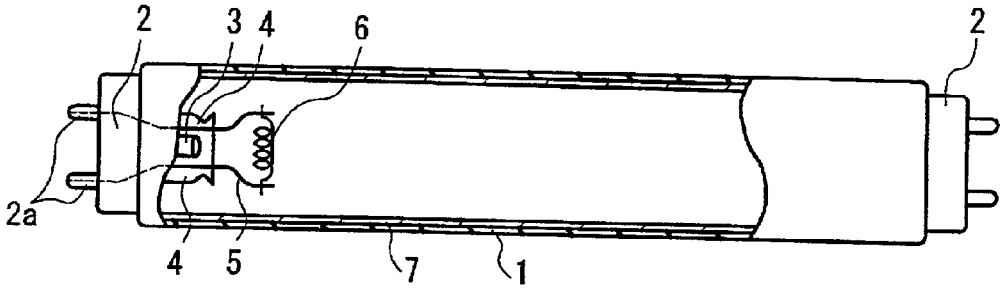
FIG. 2 PRIOR ART
FIG. 2 is a partially broken front view showing a straight-tubular fluorescent lamp produced by the above method for producing the fluorescent lamp.

As shown in FIG. 2, a straight-tubular fluorescent lamp with a rated power of 20 W, which is an embodiment of the present invention, includes a glass bulb 1, 600 mm in length and 28 mm in outer diameter, made of a soda-lime glass with lamp bases 2 provided at both ends of this glass bulb 1.

The both ends of the glass bulb 1 are sealed by stems 4 made of a lead glass, each of which has an exhaust pipe 3 having an inner diameter of 2 mm. Two lead wires whose one ends are connected to power pins 2*a* of the lamp base 2 penetrate this stem 4. A filament 6 made of tungsten coated with an emissive material such as barium oxide bridges the other ends of these lead wires 5.

An inner surface of the glass bulb 1 is provided with a three-band fluorescent coating 7 formed of a rare earth element.

Furthermore, 7 mg of mercury and 260 MPa of argon gas are sealed in the glass bulb 1.

Next, a method for producing such a straight-tubular fluorescent lamp will be described.

First, on a washed and dried inner surface of the glass bulb 1, a fluorescent substance coating solution is applied and dried, and then heated to form the fluorescent coating 7.

Then, the stems 4, provided with the exhaust pipes 3, the lead wires 5 and the filaments 6 in advance, are sealed at both ends of the glass bulb 1.

Subsequently, an impure gas in the glass bulb 1 is exhausted through the exhaust pipe 3. Immediately before finishing the exhaustion, a mercury-containing material 8, obtained by coating a surface of liquid mercury 9 with a continuous film as described below, and an argon gas (an enclosed gas) are introduced into the glass bulb 1 through the exhaust pipe 3, which then is sealed by cutting. Thereafter, the lamp bases 2 are attached to both ends of the glass bulb 1, thus producing a fluorescent lamp.

In this process of producing the fluorescent lamp, after being enclosed in the glass bulb 1 through the exhaust pipe 3, the mercury-containing material 8 contacts the inner surface of the glass bulb 1 (more accurately, the fluorescent coating 7). At this time, the liquid mercury 9 inside evaporates (at least 300 Pa) by heat during exhausting the glass bulb 1 (for an efficient exhaustion, the glass bulb 1 usually is heated at several hundred degrees during the exhaustion). This pressure partially breaks the continuous film 10, and then the evaporated mercury is released inside the glass bulb 1.

Since all the mercury is released inside the glass bulb 1, only the continuous film remains of the mercury-containing material 8 after the release.

In the following, the mercury-containing material used in the above-described method for producing the fluorescent lamp will be described.

Figure 1:
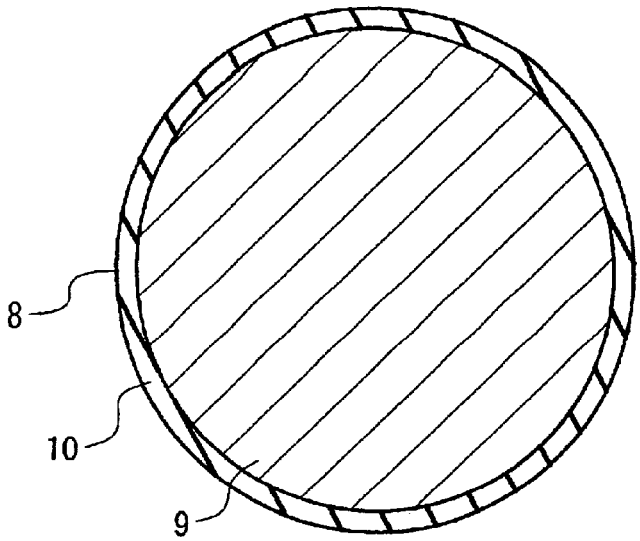
FIG. 1 is a sectional front view showing a mercury-containing material used in a method for producing a fluorescent lamp as an embodiment of the present invention.

As shown in FIG. 1, the mercury-containing material 8 is a spherical body about 1 mm in diameter, in which the surface of the liquid mercury 9 (7 mg) is coated with the 0.3 mm thick continuous film 10 formed of a metal oxide such as aluminum oxide. In the present embodiment, the spherical body means a substantially spherical body.

The size of the mercury-containing material preferably is 0.5 to 2.0 mm, and more preferably is 0.5 to 1.0 mm. With this size, the mercury-containing material easily can be enclosed without adhering to an inner surface of an enclosing apparatus or the exhaust pipes. Also, the enclosed mercury does not remain in the glass bulb without evaporating.

As described above, the spherical mercury-containing material 8 easily can be enclosed in the glass bulb 1 through the exhaust pipe 3 without getting snagged on the enclosing apparatus (not shown) or the exhaust pipes 3.

In the present invention, "the continuous film 10" includes both a single-layer film and a multiple-layer film.

By using metal oxide or metal complex oxide as the continuous film 10, it is possible to prevent a reaction between a substance forming the continuous film 10 and an activated mercury ion during the lamp operation, which would lead to a decrease in mercury contributing to a discharge.

In order to prevent the film from breaking during handling in the producing process, the thickness of the continuous film 10 preferably is at least 0.05 mm, and more preferably at least 0.1 mm. On the other hand, since an excessively thick continuous film 10 is difficult to break when it should be broken intentionally as described below, the continuous film 10 preferably is not thicker than 1 mm in practice.

When the continuous film 10 is formed by layering a plurality of films, the thickness of the continuous film 10 corresponds to a total thickness of the layered films.

The following is a description of a method for producing the mercury-containing material 8 described above.

First, in a noble gas atmosphere such as an argon gas atmosphere, the liquid mercury 9 is dropped in a container filled with liquid nitrogen, so as to be solidified. The liquid mercury 9 is solidified in the noble gas atmosphere in order to prevent impurities (such as moisture) that affect characteristics of the fluorescent lamp adversely from adhering to the surface of the liquid mercury 9 during the solidification.

Thereafter, the resultant solid mercury (not shown) is dipped in a continuous film forming solution formed of a metal alkoxide solution maintained at −40° C., so that the continuous film forming solution is gel-coated (made to adhere) onto the surface of the solid mercury. At this time, because the mercury has been solidified, it is easy to handle. As the continuous film forming solution, a solution containing ethyl alcohol as a main component and 3 wt % of aluminum isopropoxide is used.

The metal alkoxide used for the production of the metal containing material of the present invention indicates a compound in which an alkyl group is bonded to a metal atom via an oxygen atom. This alkyl group can be a lower alkyl group such as methyl, ethyl, n-propyl, isopropyl, n-butyl, isobutyl, sec-butyl, n-pentyl, isopentyl or sec-pentyl. The metal can be aluminum, silicon, titanium, cerium, antimony or yttrium. Specifically, the metal alkoxide can be aluminum isopropoxide, aluminum sec-butoxide, silicon methoxide, silicon ethoxide, titanium isopropoxide, titanium butoxide, cerium ethoxide or yttrium trimethoxide but is not limited to these. In particular, the metal alkoxide preferably is aluminum isopropoxide, silicon ethoxide, titanium isopropoxide, titanium butoxide, cerium ethoxide or yttrium trimethoxide.

The metal alkoxide suitably is used in a form of a metal alkoxide solution obtained by dissolving liquid or powder metal alkoxide in a solvent. This solvent may be any solvent that does not inhibit hydrolysis and polymerization reaction of the metal alkoxide. For example, it can be 1,4-dioxane, dimethylformamide, dimethylacetamide, toluene, xylene, a normal alcohol such as methanol, ethanol, n-propyl alcohol and isopropyl alcohol, or alkoxy alcohol such as 2-methoxy ethanol and 2-ethoxy ethanol. In particular, the solvent preferably is a normal alcohol such as methanol, ethanol, n-propyl alcohol and isopropyl alcohol. The metal alkoxide is dissolved in the solvent in a concentration of equal to or smaller than 90 wt %, preferably 1 wt % to 80 wt %.

Although moisture in the air and that initially contained in the solvent usually are enough for the hydrolysis and polycondensation of the metal alkoxide solution, a catalyst such as a small amount of water also may be added so as to accelerate the hydrolysis.

The temperature of the metal alkoxide solution cannot be defined uniformly but has to be selected individually considering a reactivity of the metal alkoxide. In general, the temperature is maintained at 30° C. or lower. When the solidified mercury is used, it preferably is maintained at 0° C. or lower, and more preferably at −50° C. to 0° C., so as to prevent liquefaction of the solid mercury.

Next, the solid mercury whose surface has been gel-coated is put into a fire at 500° C. or higher, preferably at 600° C. to 1,000° C. for 1 second or several seconds, thus forming the continuous film 10 on the surface of the solid mercury that is partially liquefied by heat of the fire. The fire preferably is obtained by burning a mixed gas of a natural gas and oxygen, by which moisture is not generated very much at the time of burning. By using such a fire, it is possible to prevent the continuous film 10 from absorbing the moisture, thereby reducing an adverse effect on the lamp characteristics caused by the moisture absorption.

In the process of forming the continuous film 10, it is particularly preferable that a plurality of thin films (having a thickness of 50 to 100 $\mu$m) are layered by repeating the above-described forming process several times, so as to form a continuous film 10. This is because when attempting to form a thick continuous film 10 at one time, a large amount of the continuous film forming solution has to be made adhere to the surface of the solid mercury, and therefore, a considerably larger amount of heat becomes necessary in a heating process for forming the continuous film 10. Consequently, the continuous film forming solution on the solid mercury surface is heated abruptly, so that impurities contained in the continuous film forming solution are not released but absorbed in the continuous film 10. These impurities may affect the lamp characteristics adversely.

Furthermore, when the continuous film 10 is formed by repeating the continuous film 10 forming processes a plurality of times so as to layer a plurality of the thin films, it is preferable that the innermost thin film is thinnest. This can reduce the amount of heat applied to the continuous film forming solution in the process of forming the first thin film (continuous film), that is, the process of heating the continuous film forming solution that is in direct contact with the solid mercury. As a result, the amount of heat applied to the solid mercury can be reduced, thereby suppressing the evaporation of the mercury and increasing the accuracy of the enclosed mercury amount.

When forming the second film and thereafter, since the thin film already is formed on the surface of the solid mercury, the evaporation of the mercury can be suppressed even if a large amount of heat is applied to the solid mercury.

In addition, the thickness of the continuous film 10 (thin film) can be adjusted according to the viscosity and concentration of the continuous film forming solution, the dipping time, the number of dippings and the drying method.

As described above, the mercury-containing material 8 is produced. When the production is finished, the mercury inside the mercury-containing material 8 already is liquefied.

Figure 3:
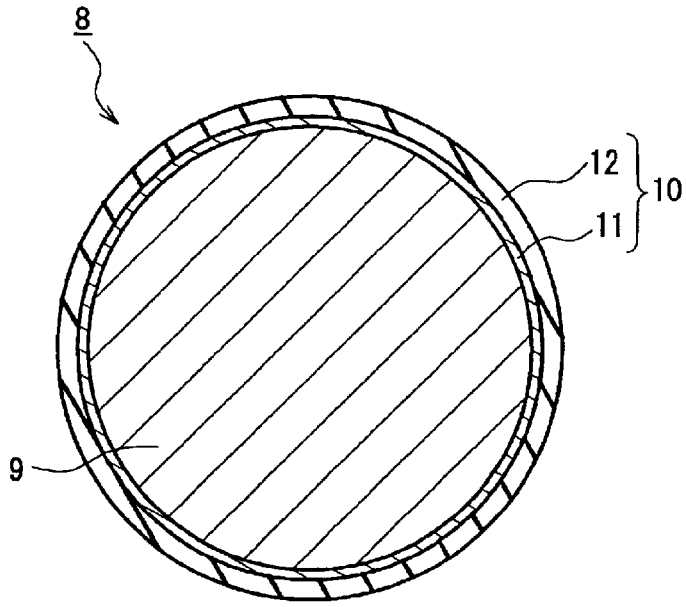
FIG. 3 is a sectional front view showing a mercury-containing material used in a method for producing a fluorescent lamp as another embodiment of the present invention.

FIG. 3 is a sectional front view showing a mercury-containing material used in a method for producing a fluorescent lamp of the embodiment. The inner film is 11. The outer film is 12. The continuous film is 10.

Figure 4:
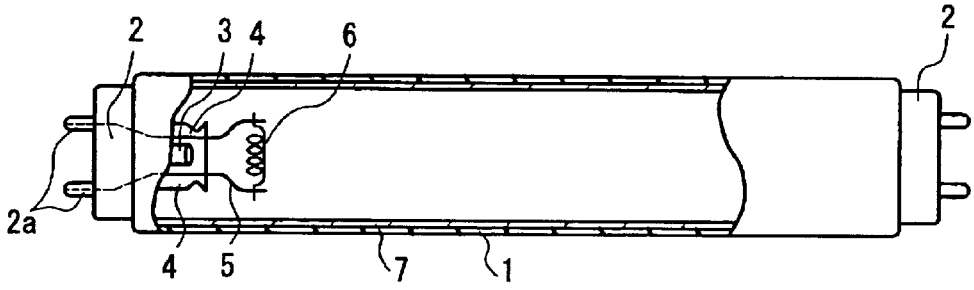
FIG. 4 is a partially broken front view showing a straight-tubular fluorescent lamp as an embodiment of the present invention.

The fluorescent lamp produced by the method for producing the fluorescent lamp, which is an embodiment of the present invention, (hereinafter, referred to as a product of the present invention, FIG. 4) also has the continuous film 10 remaining in the fluorescent lamp after the mercury is released (not shown). In order to evaluate an effect of this remaining continuous film 10 on the fluorescent lamp, flaws on the fluorescent coating 7, noises and appearance were examined in the product of the present invention by a vibration test, so as to obtain the following results.

In the vibration test, 10 to 55 Hz vibrations at 1 G were presented with a ½ octave sweep for 60 minutes. This vibration condition corresponds to the case where a fluorescent lamp is put in a corrugated cardboard package and transported in a car for a distance of about 1,000 km.

In particular, with respect to the flaws on the fluorescent coating 7 by the vibration test, another straight-tubular fluorescent lamp with a rated power of 20 W (hereinafter, referred to as a conventional product) was produced for comparison. The conventional product was produced by the same method as that for producing the product of the present invention except that, instead of the mercury-containing material 8, 14 mg of a mercury alloy formed of mercury and zinc (weight ratio was 50:50) was enclosed in the glass bulb 1. The conventional product was examined under the same condition as that for the product of the present invention.

The number of samples was 25 for each of the product of the present invention and the conventional product.

It was found that no product of the present invention had linear or pinhole-shaped flaws in the fluorescent coating 7. On the other hand, the conventional product had about 30 pinhole-shaped flaws with a size of about 0.05 to 0.30 mm in the fluorescent coating 7. This indicated that the remaining continuous film 10 itself had a very small possibility for damaging the fluorescent coating 7. This may be attributable to flexibility of the continuous film 10.

Even when the products of the present invention were inclined or shaken, no noise was generated. This also may be attributable to the flexibility of the continuous film 10.

Furthermore, when the products of the present invention were operating, no shadow of the continuous film 10 appeared. Accordingly, the products of the present invention did not have any problems in their appearance. This may be because the continuous film 10 was thin so as to have a large light transmittance.

As described above, in accordance with the method for producing the fluorescent lamp as the embodiment of the present invention, a minimal amount of mercury can be enclosed in the fluorescent lamp precisely, thus achieving friendliness to the environment. It also is possible to prevent flaws in the fluorescent coating 7 while suppressing a noise during the lamp transportation and further to prevent deterioration in appearance.

In the embodiment described above, the straight-tubular fluorescent lamp with a rated power of 20 W was produced. However, the present invention also can be applied to, for example, straight-tubular fluorescent lamps with a rated power of 32 W and 40 W, round-tubular, U-shaped and W-shaped fluorescent lamps and fluorescent lamps using a plurality of cells provided in one or more glass plates.

Also, in the embodiment described above, the continuous film 10 formed of the metal oxide was used. However, a continuous film formed of a metal foil such as an aluminum foil can be used to obtain an effect similar to the above.

Furthermore, in the embodiment described above, the fluorescent coating 7 was formed directly on the inner surface of the glass bulb 1. However, a particulate or continuous protective film or a transparent electrically conductive coating can be formed between the glass bulb 1 and the fluorescent coating 7 to obtain an effect similar to the above.

Moreover, in the embodiment described above, the solution containing ethyl alcohol as a main component and aluminum isopropoxide was used as the continuous film forming solution. However, other metal alkoxide (for example, tetraethoxyoxysilane (TEOS)) can be used to obtain an effect similar to the above.

In the embodiment described above, after the liquid mercury 9 was solidified, the resultant solid mercury was dipped in the continuous film forming solution. However, the liquid mercury 9 can be dipped in the continuous film forming solution to obtain an effect similar to the above.

Also, in the embodiment described above, the three-band fluorescent coating 7 formed of the rare earth element was used. However, a halophosphate-based fluorescent coating, for example, can be used to obtain an effect similar to the above.

Furthermore, in the embodiment described above, the liquid mercury 9 was solidified using the liquid nitrogen. However, the liquid mercury 9 can be solidified using liquefied argon, krypton or xenon to obtain an effect similar to the above.

The invention may be embodied in other specific forms without departing from the spirit or essential characteristics thereof. The embodiments disclosed in this application are to be considered in all respects as illustrative and not restrictive, the scope of the invention being indicated by the appended claims rather than by the foregoing description, all changes that come within the meaning and range of equivalency of the claims are intended to be embraced therein.

What is claimed is:

1. A mercury-containing material comprising:

liquid mercury; and a continuous film with which a surface of the liquid mercury is coated, wherein the continuous film is formed by layering a plurality of thin films, wherein after said mercury-containing material is enclosed in a glass bulb, the liquid mercury inside said mercury-containing material evaporates by heat, a pressure built up by the evaporation breaks the continuous film, and the evaporated mercury is released inside the glass bulb.

2. The mercury-containing material according to claim 1, wherein the continuous film is made of at least one material selected from the group consisting of a metal oxide and a metal complex oxide.

3. The mercury-containing material according to claim 1, wherein the continuous film has a thickness of 0.1 to 1.0 mm.

4. The mercury-containing material according to claim 1, wherein an innermost thin film of the thin films constituting the continuous film is thinnest.

5. The mercury-containing material according to claim 1, wherein the mercury-containing material is a spherical body.

6. The mercury-containing material according to claim 1, wherein the mercury-containing material is obtained by making a metal alkoxide solution adhere onto a surface of mercury and heating the metal alkoxide solution on the surface of the mercury.

7. A fluorescent lamp comprising:

a glass bulb, in which an enclosed gas and a mercury-containing material are sealed, the mercury-containing material comprising liquid mercury and a continuous film with which a surface of the liquid mercury is coated; and a fluorescent coating formed on an inner surface of the glass bulb, wherein the continuous film of the mercury-containing material is formed by layering a plurality of thin films, wherein after said mercury-containing material is enclosed in a glass bulb, the liquid mercury inside said mercury-containing material evaporates by heat, a pressure built up by the evaporation breaks the continuous film, and the evaporated mercury is released inside the glass bulb.

8. The fluorescent lamp according to claim 7, wherein the continuous film of the mercury-containing material is made of at least one material selected from the group consisting of a metal oxide and a metal complex oxide.

9. The fluorescent lamp according to claim 7, wherein the continuous film of the mercury-containing material has a thickness of 0.1 to 1.0 mm.

10. The fluorescent lamp according to claim 7, wherein an innermost thin film of the thin films constituting the continuous film of the mercury-containing material is thinnest.

11. The fluorescent lamp according to claim 7, wherein the mercury-containing material is a spherical body.

12. The fluorescent lamp according to claim 7, wherein the mercury-containing material is obtained by making a metal alkoxide solution adhere onto a surface of mercury and heating the metal alkoxide solution on the surface of the mercury.

* * * * *